US011054785B2

(12) United States Patent
Hiroi

(10) Patent No.: US 11,054,785 B2
(45) Date of Patent: Jul. 6, 2021

(54) IMAGE FORMING APPARATUS

(71) Applicant: Oki Data Corporation, Tokyo (JP)

(72) Inventor: Masakazu Hiroi, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 373 days.

(21) Appl. No.: 16/105,035

(22) Filed: Aug. 20, 2018

(65) Prior Publication Data

US 2019/0086855 A1 Mar. 21, 2019

(30) Foreign Application Priority Data

Sep. 21, 2017 (JP) ..... JP2017-180799

(51) Int. Cl.
*G03G 15/00* (2006.01)

(52) U.S. Cl.
CPC ..... *G03G 15/6564* (2013.01); *G03G 15/5054* (2013.01); *G03G 15/6517* (2013.01); *G03G 2215/00409* (2013.01); *G03G 2215/00599* (2013.01)

(58) Field of Classification Search
CPC ..... G03G 15/6564
USPC ..... 399/394
See application file for complete search history.

(56) References Cited

U.S. PATENT DOCUMENTS 6,014,542 A * 1/2000 Hozumi ..... G03G 15/6564 399/394
6,831,441 B1 * 12/2004 Navalon Carretero ... H02P 7/29 318/432
8,731,453 B2 * 5/2014 Inoue ..... G03G 15/6564 399/396
2008/0128980 A1 * 6/2008 Morya ..... B65H 9/002 271/227
2008/0240821 A1 * 10/2008 Shoji ..... G03G 15/6567 399/395
2011/0200341 A1 * 8/2011 Moriya ..... B65H 9/002 399/16
2014/0099135 A1 * 4/2014 Hiratsuka ..... G03G 15/5054 399/66

(Continued)

FOREIGN PATENT DOCUMENTS

JP 2010277038 A 12/2010
JP 2017138548 A 8/2017

*Primary Examiner* — Anthony H Nguyen
(74) *Attorney, Agent, or Firm* — Panitch Schwarze Belisario & Nadel LLP

(57) ABSTRACT

Provided is an image forming apparatus including an intermediate transfer body; a secondary transfer section; a conveyance section; a first detection section; a second detection section that is arranged downstream of the first detection section in a conveyance direction of a medium; and a control section that performs control for changing a conveyance speed of the medium by the conveyance section to a first speed based on timing of detection of the medium by the first detection section and a position of the image on the intermediate transfer body at that time point and changing the conveyance speed of the medium by the conveyance section to a second speed equal to the traveling speed of the intermediate transfer body based on timing of detection of the medium by the second detection section and the position of the image on the intermediate transfer body at that time point.

12 Claims, 12 Drawing Sheets

(56) References Cited

U.S. PATENT DOCUMENTS

2014/0145397 A1* 5/2014 Aoki ..... G03G 15/65
271/228
2017/0153566 A1* 6/2017 Hashimoto ..... G03G 15/5029

* cited by examiner

IMAGE FORMING APPARATUS

CROSS-REFERENCE TO RELATED APPLICATION

This application claims priority under 35 U.S.C. § 119(b) to Japanese Application No. 2017-180799, filed Sep. 21, 2017, the disclosure of which is incorporated by reference herein in its entirety.

BACKGROUND OF THE INVENTION

1. Field of the Invention

The present invention relates to an image forming apparatus that forms an image on a medium by means of electrophotography (specifically, an intermediate transfer method).

2. Description of the Related Art

In an image forming apparatus employing the intermediate transfer method, a toner image formed on a photosensitive drum (image bearing body) is primarily transferred onto an intermediate transfer belt (intermediate transfer body) and is further transferred secondarily from the intermediate transfer belt to a medium. At the time of the secondary transfer, the toner image on the intermediate transfer belt and the medium have to be registered with each other. Therefore, the medium is conveyed to a secondary transfer section in sync with the timing of the arrival of the toner image on the intermediate transfer belt at the secondary transfer section (see Patent Reference 1, for example).

Patent Reference 1: Japanese Patent Application Publication No. 2010-277038 (see FIG. 4)

There are cases where an image is formed on a label of a medium, made by forming labels on a long-shaped base sheet (e.g., label roll paper), by using an image forming apparatus of the above-described type. However, misregistration of the label and the toner image or the jam with the medium can occur since the distance from the front end of the base sheet to the label can be too short or too long depending on the type of the medium.

SUMMARY OF THE INVENTION

The object of the present invention, which has been made to resolve the above-described problem, is to provide an image forming apparatus capable of improving the quality of the image and inhibiting the occurrence of the jam with the medium.

An image forming apparatus according to the present invention includes an image forming section that forms an image; an intermediate transfer body traveling at a prescribed speed, the image formed by the image forming section being primarily transferred onto the intermediate transfer body; a secondary transfer section that secondarily transfers the image on the intermediate transfer body onto a medium; a conveyance section that conveys the medium to the secondary transfer section; a first detection section that detects the medium; a second detection section that is arranged downstream of the first detection section in a conveyance direction of the medium by the conveyance section and detects the medium; and a control section that performs control for changing a conveyance speed of the medium by the conveyance section to a first speed based on timing of detection of the medium by the first detection section and a position of the image on the intermediate transfer body at a time point when the medium is detected by the first detection section and changing the conveyance speed of the medium by the conveyance section to a second speed equal to the traveling speed of the intermediate transfer body based on timing of detection of the medium by the second detection section and the position of the image on the intermediate transfer body at a time point when the medium is detected by the second detection section.

In the present invention, the conveyance speed of the medium is changed to the first speed based on the timing of detection of the medium by the first detection section and the position of the image on the intermediate transfer body at that time point, and the conveyance speed of the medium is changed to the second speed (equal to the traveling speed of the intermediate transfer body) based on the timing of detection of the medium by the second detection section and the position of the image on the intermediate transfer body at that time point, which makes it possible to precisely register the image on the intermediate transfer body and the medium with each other. Consequently, the quality of the image can be improved and the occurrence of the jam with the medium can be inhibited.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications will become apparent to those skilled in the art from the detailed description.

First Embodiment (Configuration of Image Forming Apparatus)

Figure 1:
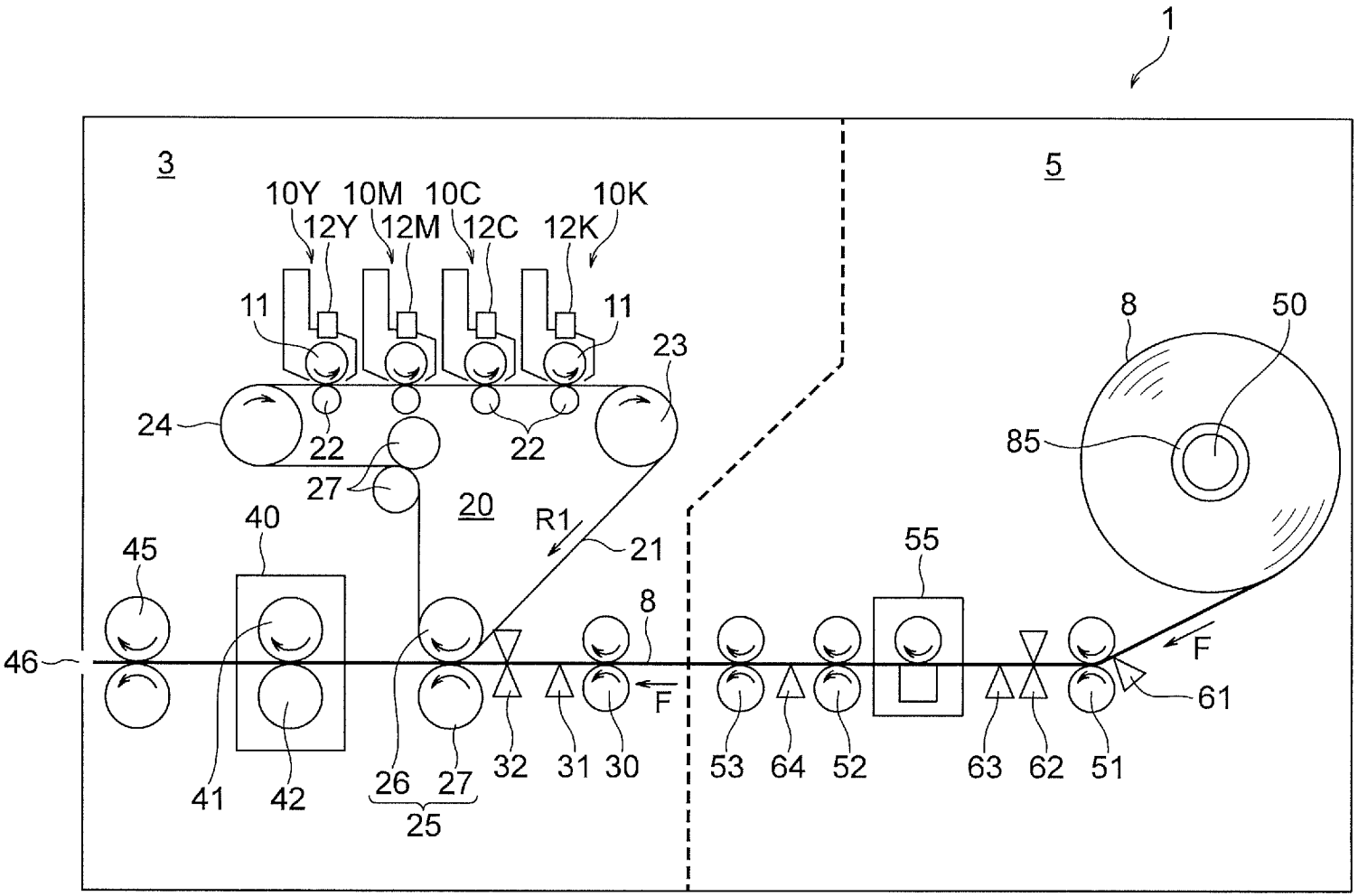
FIG. 1 is a diagram showing the overall configuration of an image forming apparatus in a first embodiment.

FIG. 1 is a diagram showing the overall configuration of an image forming apparatus 1 in a first embodiment of the present invention. The image forming apparatus 1 includes a feeder section 5 that supplies a medium 8 such as label roll paper and a print section 3 that prints an image on the medium 8 supplied from the feeder section 5.

Figure 2:
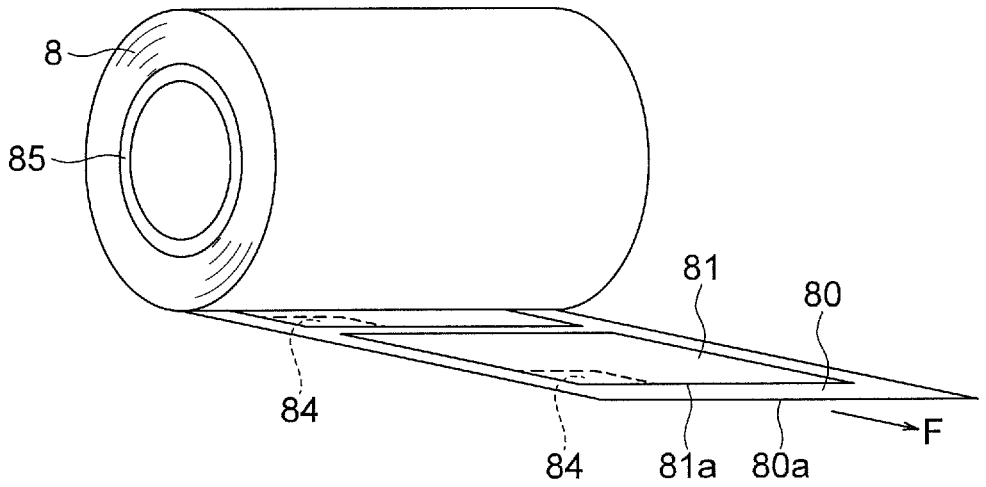
FIG. 2 is a perspective view showing an example of a medium used in the first embodiment.

First, the medium 8 used in the image forming apparatus 1 will be explained below. FIG. 2 is a perspective view showing an example of the medium 8 used in the image forming apparatus 1. The medium 8 is formed by sticking labels 81 on a surface of a long-shaped base sheet 80, and each label 81 serves as an image formation region. The medium 8 is wound around a cylindrical roll core 85.

The labels 81 are arranged at fixed intervals in a lengthwise direction of the base sheet 80. On the back surface of the medium 8 (surface opposite to the labels 81), black marks 84 (position detection marks) indicating the positions of the labels 81 are formed as represented by dotted lines in FIG. 2. The black mark 84 is formed at a position corresponding to a corner part of the label 81 at the front end of the label 81 in the conveyance direction, for example. Incidentally, the black mark 84 is not limited to this type of mark; the black mark 84 may be any type of mark enabling the detection of the position of the label 81.

Parenthetically, while the medium 8 is described as label roll paper in this example, the medium 8 is not limited to label roll paper; the medium 8 may also be continuous paper such as fanfold paper, for example.

Returning to FIG. 1, the feeder section 5 of the image forming apparatus 1 includes a medium holder (medium holding section) 50 that holds the rolled medium 8, first conveyance rollers 51 that extract the medium 8 from the medium holder 50 and convey the medium 8, second conveyance rollers 52, third conveyance rollers 53, and a cutter section (cutting section) 55 that cuts the medium 8.

The medium holder 50 rotatably holds the roll core 85 of the medium 8. The first conveyance rollers 51, the second conveyance rollers 52 and the third conveyance rollers 53 are arranged in this order along a conveyance path of the medium 8. The first conveyance rollers 51, the second conveyance rollers 52 and the third conveyance rollers 53 are rotated by motors (sheet feed motors) controlled by a feeder control section 150 (FIG. 4) and convey the medium 8 in the conveyance direction indicated by the arrows F. Incidentally, the medium 8 is conveyed with its label 81 side facing upward and its base sheet 80 side facing downward.

The cutter section 55 is arranged between the first conveyance rollers 51 and the second conveyance rollers 52. The cutter section 55 is implemented by a rotary cutter using a rotary blade, a guillotine cutter, or the like, for example. The cutter section 55 is actuated by an actuator controlled by the feeder control section 150 (FIG. 4) and cuts the medium 8.

A first medium sensor 61, a second medium sensor 62, a third medium sensor 63 and a fourth medium sensor 64 for detecting the medium 8 are arranged along the conveyance path of the medium 8. The first medium sensor 61 is an optical sensor of the reflective type, for example, and is arranged upstream of the first conveyance rollers 51 in the conveyance direction of the medium 8. The first medium sensor 61 detects whether a medium 8 has been set in the feeder section 5.

The second medium sensor 62 is an optical sensor of the transmissive type, for example, and is arranged between the first conveyance rollers 51 and the cutter section 55 in the conveyance direction of the medium 8. The second medium sensor 62 is capable of detecting both the base sheet 80 and the labels 81 by using the difference in transmittance between the base sheet 80 and the labels 81 constituting the medium 8.

The third medium sensor 63 is an optical sensor of the reflective type, for example, and is arranged between the second medium sensor 62 and the cutter section 55 in the conveyance direction of the medium 8. The third medium sensor 63 detects the black marks 84 (FIG. 2) formed on the back surface of the medium 8.

The fourth medium sensor 64 is a mechanical sensor, for example, and is arranged between the second conveyance rollers 52 and the third conveyance rollers 53 in the conveyance direction of the medium 8. The fourth medium sensor 64 detects the rear end of the medium 8 cut by the cutter section 55. The fourth medium sensor 64 is used for a judgment on whether or not the medium 8 has been cut normally.

The print section 3 of the image forming apparatus 1 includes process units 10Y, 10M, 10C and 10K as image forming sections, an intermediate transfer belt 21 as an intermediate transfer body onto which a toner image (developing agent image) formed in each process unit 10Y, 10M, 10C, 10K is primarily transferred, a secondary transfer section 25 that secondarily transfers the toner image on the intermediate transfer belt 21 onto the medium 8, conveyance rollers 30 (conveyance section) that convey the medium 8 to the secondary transfer section 25, a fixation device 40 that fixes the toner image transferred to the medium 8 on the medium 8, and ejection rollers 45 (ejection unit) that eject the medium 8 on which the toner image has been fixed.

The process units 10Y, 10M, 10C and 10K are arranged in a traveling direction of the intermediate transfer belt 21, and specifically, aligned from left to right in FIG. 1 in this example. The process units 10Y, 10M, 10C and 10K, each including a photosensitive drum 11 as an image bearing body, form yellow, magenta, cyan and black toner images.

LED heads 12Y, 12M, 12C and 12K as exposure devices are arranged to respectively face the photosensitive drums 11 of the process units 10Y, 10M, 10C and 10K.

The process units 10Y, 10M, 10C and 10K will hereinafter be referred to collectively as process units 10 since all the process units 10Y, 10M, 10C and 10K have a common configuration except for the toner used therein. Similarly, the LED heads 12Y, 12M, 12C and 12K will be referred to collectively as LED heads 12.

Figure 3:
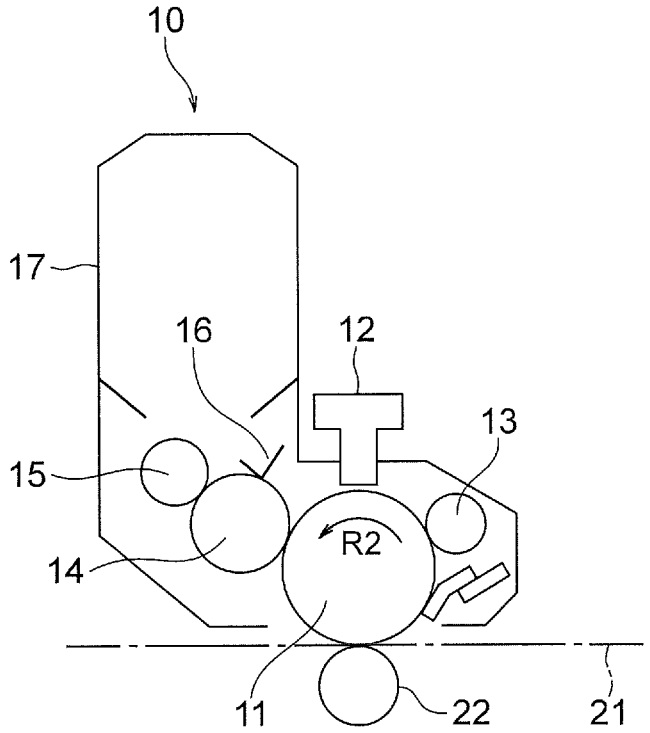
FIG. 3 is a schematic diagram showing a configuration example of a process unit (image forming section) in the first embodiment.

FIG. 3 is a schematic diagram showing a configuration example of the process unit 10. The process unit 10 includes the photosensitive drum 11 as the image bearing body, a charging roller 13 as a charging member, the LED head 12 as the exposure device, a development roller 14 as a developing agent bearing body, a supply roller 15 as a supply member, a development blade 16 as a developing agent regulation member, and a toner cartridge 17 as a developing agent container.

Figure 4:
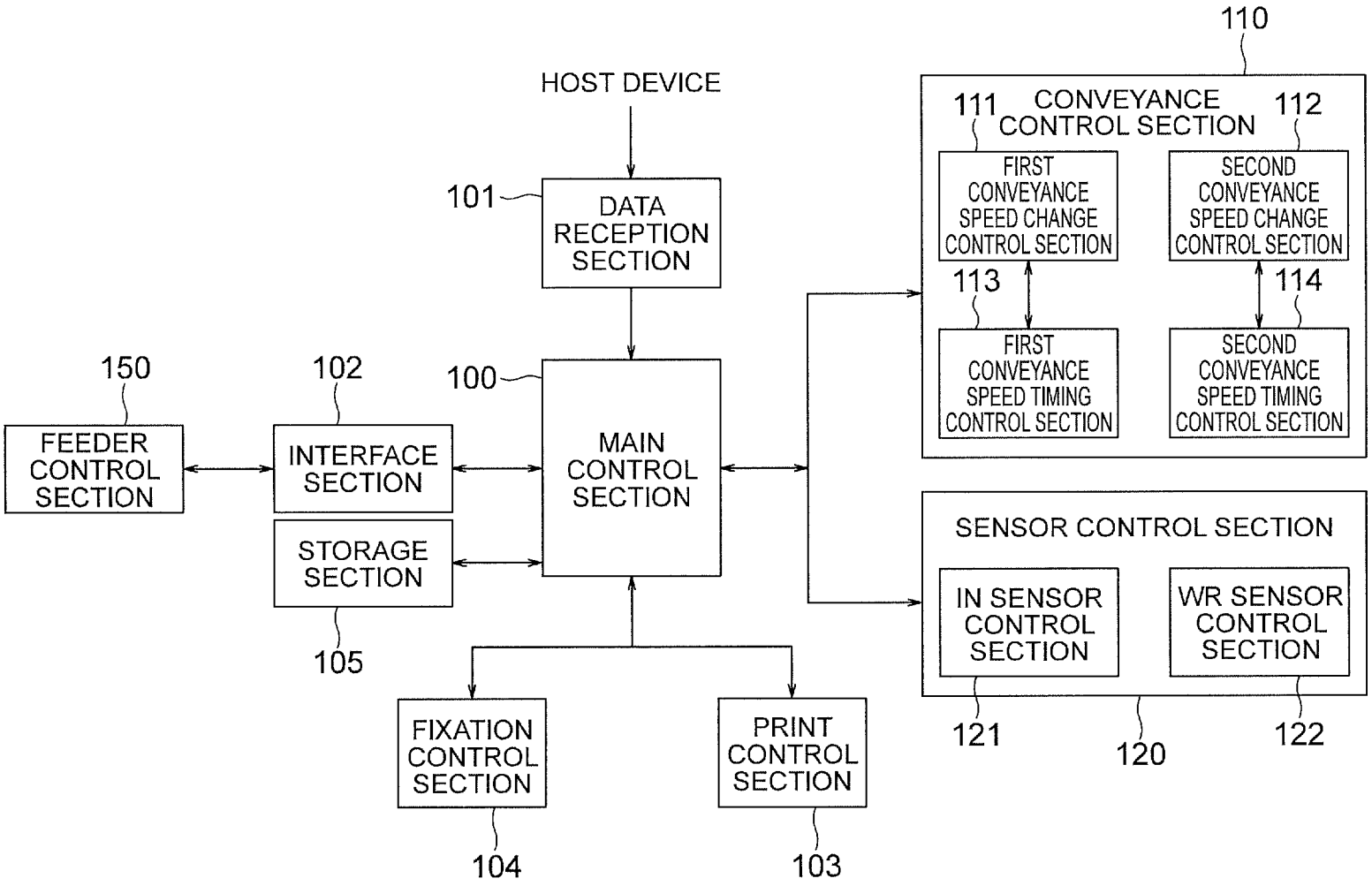
FIG. 4 is a block diagram showing a control system of the image forming apparatus in the first embodiment.

The photosensitive drum 11 is made by forming a photosensitive layer (an electric charge generation layer and a electric charge transport layer) on the surface of a cylindrical conductive support member. The photosensitive drum 11 is rotated counterclockwise as indicated by the arrow R2 in FIG. 3 by a motor (drum motor) controlled by a print control section 103 (FIG. 4).

The charging roller 13 is arranged to contact the surface of the photosensitive drum 11 and rotates following the rotation of the photosensitive drum 11. The charging roller 13 is supplied with a charging voltage according to control by the print control section 103 (FIG. 4) and uniformly charges the surface of the photosensitive drum 11.

The LED head 12 includes an LED array in which a plurality of LED elements (light-emitting elements) are arranged and a lens array in which a plurality of lenses are arranged. The LED head 12 irradiates the surface of the photosensitive drum 11 with light according to control by the print control section 103 and thereby forms an electrostatic latent image on the surface of the photosensitive drum 11.

The development roller 14 is arranged to contact the surface of the photosensitive drum 11 and rotates in a direction (clockwise in FIG. 3) opposite to the rotational direction of the photosensitive drum 11. The development roller 14 is supplied with a development voltage according to control by the print control section 103 (FIG. 4) and develops the electrostatic latent image on the surface of the photosensitive drum 11 with a toner.

The supply roller 15 is arranged to contact the surface of the development roller 14 and rotates in the same direction (clockwise in FIG. 3) as the rotational direction of the development roller 14. The supply roller 15 is supplied with a supply voltage according to control by the print control section 103 (FIG. 4) and supplies the toner to the development roller 14.

The development blade 16, as a blade made of metal (e.g., stainless steel) and arranged to contact the surface of the development roller 14, regulates the thickness of a toner layer formed on the surface of the development roller 14 at a constant thickness.

The toner cartridge 17 is detachably attached to the top of the main body of the process unit 10 and supplies the toner to the development roller 14 and the supply roller 15.

Returning to FIG. 1, four primary transfer rollers 22 as primary transfer sections are arranged to respectively contact the photosensitive drums 11 of the process units 10Y, 10M, 10C and 10K via the intermediate transfer belt 21.

The intermediate transfer belt 21 is arranged to pass between the photosensitive drums 11 and the primary transfer rollers 22 (i.e., pass through primary transfer nips). The intermediate transfer belt 21 is stretched across a drive roller 23, a driven roller 24 and a secondary transfer backup roller 26.

The drive roller 23 rotates clockwise in FIG. 1 and thereby makes the intermediate transfer belt 21 travel in the direction indicated by the arrow R1. The driven roller 24 gives tension to the intermediate transfer belt 21. Further, guide rollers 28 for guiding the traveling of the intermediate transfer belt 21 are provided between the secondary transfer backup roller 26 and the driven roller 24.

On the outside of the intermediate transfer belt 21, a secondary transfer roller 27 is arranged to sandwich the intermediate transfer belt 21 between the secondary transfer roller 27 and the secondary transfer backup roller 26. The secondary transfer roller 27 and the secondary transfer backup roller 26 constitute the secondary transfer section 25. The secondary transfer section 25 secondarily transfers the toner image on the intermediate transfer belt 21 onto the medium 8.

The intermediate transfer belt 21, the primary transfer rollers 22, the drive roller 23, the driven roller 24, the secondary transfer backup roller 26 and the secondary transfer roller 27 (secondary transfer section 25) constitute a transfer belt unit 20.

The conveyance rollers 30 constitute a conveyance section for conveying the medium 8, conveyed from the feeder section 5 to the print section 3, to the secondary transfer section 25. The conveyance rollers 30 are rotated by a motor (conveyance motor), such as a pulse motor, controlled by a conveyance control section 110 (FIG. 4) and convey the medium 8 in the conveyance direction indicated by the arrow F.

Along the conveyance path of the medium 8 to the secondary transfer section 25, an IN sensor 31 as a first detection section and a WR sensor 32 as a second detection section are arranged. The WR sensor 32 is arranged downstream of the IN sensor 31 in the conveyance direction of the medium 8.

The IN sensor 31 is an optical sensor of the reflective type, for example, and detects the base sheet 80 of the medium 8. The WR sensor 32 is an optical sensor of the transmissive type, for example, and is capable of detecting both the base sheet 80 and the labels 81 by using the difference in the transmittance between the base sheet 80 and the labels 81. In this example, the WR sensor 32 is used to detect the labels 81.

The fixation device 40 includes a fixation roller 41, having a built-in heat source, and a pressure roller 42. The fixation roller 41 is heated up to a constant fixation temperature according to control by a fixation control section 104 and is rotated clockwise in FIG. 1 by a motor (fixation motor) controlled by the fixation control section 104. The pressure roller 42 is pressed against the fixation roller 41 to form a fixation nip. The fixation roller 41 and the pressure roller 42 apply heat and pressure to the medium 8, onto which the toner image has been transferred by the secondary transfer section 25, and thereby fixes the toner image on the medium 8.

The ejection rollers 45 are rotated by rotary force transmitted from the fixation motor, for example, and eject the medium 8, on which the toner image has been fixed by the fixation device 40, to the outside through an outlet 46.

(Control System)

Next, a control system of the image forming apparatus 1 will be described below. FIG. 4 is a block diagram showing the control system of the image forming apparatus 1. The control system of the image forming apparatus 1 includes a main control section 100, a data reception section 101, an interface section 102, the print control section 103, the fixation control section 104, a storage section 105, the conveyance control section 110, a sensor control section 120 and the feeder control section 150.

The main control section 100, the data reception section 101, the interface section 102, the print control section 103, the fixation control section 104, the conveyance control section 110, the sensor control section 120 and the feeder control section 150 are implemented by a CPU (Central Processing Unit) executing a program stored in a memory, for example.

In this example, a CPU forming the main control section 100 and the control sections on the print section 3 side (the data reception section 101, the interface section 102, the print control section 103, the fixation control section 104, the conveyance control section 110 and the sensor control section 120) and a CPU forming the feeder control section 150 on the feeder section 5 side are provided separately, and the main control section 100 and the feeder control section 150 are connected to each other by the interface section 102.

The data reception section 101 receives a print command and print data from a host device such as a personal computer. The main control section 100 (control section) controls a main sequence of the image forming apparatus 1 according to the print command and the print data received by the data reception section 101. The storage section 105 is a memory or the like that stores data necessary for the main control section 100 to control the image forming apparatus 1.

The interface section 102 is a UART (Universal Asynchronous Receiver/Transmitter) interface for allowing the main control section 100 and the feeder control section 150 to communicate with each other as mentioned above.

The feeder control section 150 controls the rotation of the conveyance rollers 51, 52 and 53, the operation of the cutter section 55, etc. in the feeder section 5 according to control signals from the main control section 100.

The print control section 103 controls parts of the process units 10 and the transfer belt unit 20 according to control signals from the main control section 100. Specifically, the print control section 103 controls the rotation of the photosensitive drums 11 of the process units 10, the light emission of the LED heads 12, and the voltages applied to the charging rollers 13, the development rollers 14 and the supply rollers 15. Further, the print control section 103 controls the rotation of the drive roller 23 of the transfer belt unit 20, the voltages (primary transfer voltages) applied to the primary transfer rollers 22, and the voltage (secondary transfer voltage) applied to the secondary transfer roller 27.

The fixation control section 104 controls the surface temperature of the fixation roller 41 and the rotation of the fixation roller 41 according to control signals from the main control section 100.

The sensor control section 120 includes an IN sensor control section 121 and a WR sensor control section 122 to which detection signals from the IN sensor 31 and the WR sensor 32 are respectively inputted. Output signals of the IN sensor control section 121 and the WR sensor control section 122 are inputted to the conveyance control section 110 which will be explained next.

The conveyance control section 110 controls the conveyance of the medium 8 by the conveyance rollers 30. Specifically, the conveyance control section 110 controls the rotation of the conveyance rollers 30 according to a control signal from the main control section 100 and the output signal of the IN sensor control section 121 or the WR sensor control section 122.

The conveyance control section 110 switches the revolution speed of the conveyance rollers 30 (i.e., the conveyance speed of the medium 8) between a second conveyance speed Vf (second speed) equal to the traveling speed Vb of the intermediate transfer belt 21 and a first conveyance speed Vs (first speed) lower than the second conveyance speed Vf. The first conveyance speed Vs is a speed that is 20%-30% lower than the second conveyance speed Vf, for example, but is not limited to such speeds.

The conveyance control section 110 includes a first conveyance speed change control section 111 (first speed change section) that changes the conveyance speed by the conveyance rollers 30 to the first conveyance speed Vs according to the output signal of the IN sensor control section 121 and a second conveyance speed change control section 112 (second speed change section) that changes the conveyance speed by the conveyance rollers 30 from the first conveyance speed Vs to the second conveyance speed Vf according to the output signal of the WR sensor control section 122.

The conveyance control section 110 further includes a first conveyance speed timing control section 113 (first timing determination section) that determines the timing of the change to the first conveyance speed Vs and a second conveyance speed timing control section 114 (second timing determination section) that determines the timing of the change to the second conveyance speed Vf.

Incidentally, the main control section 100 continuously transmits information on the revolution speed of the conveyance rollers 30 in the conveyance control section 110 (the conveyance speed of the medium 8) to the feeder control section 150 since it is necessary to make the conveyance speed of the medium 8 in the print section 3 and that in the feeder section 5 coincide with each other. The feeder control section 150 controls the revolution speeds of the conveyance rollers 51, 52 and 53 based on the speed information received from the main control section 100.

(Operation of Image Forming Apparatus)

Figure 5:
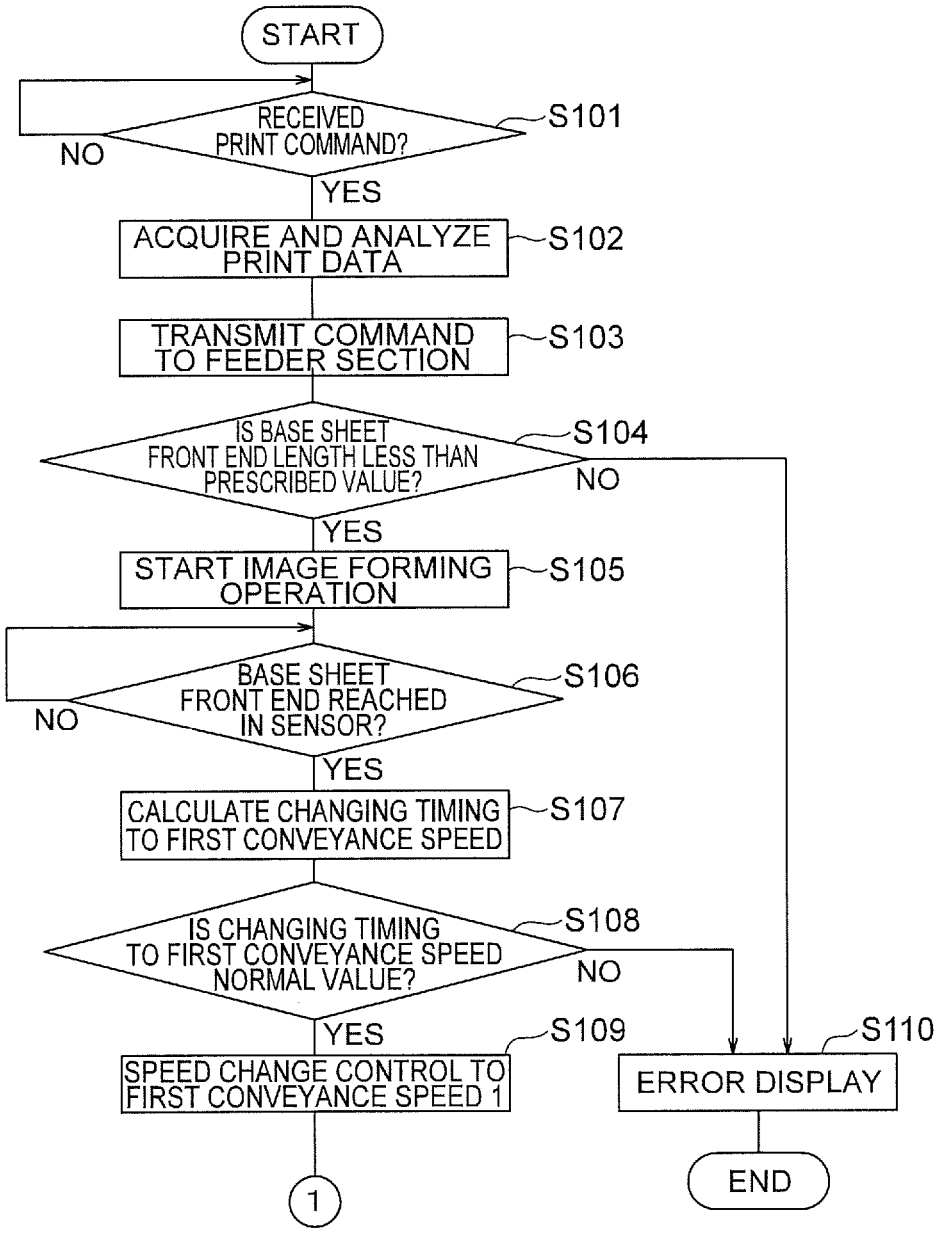
FIG. 5 is a flowchart showing the operation of the image forming apparatus in the first embodiment.
Figure 6:
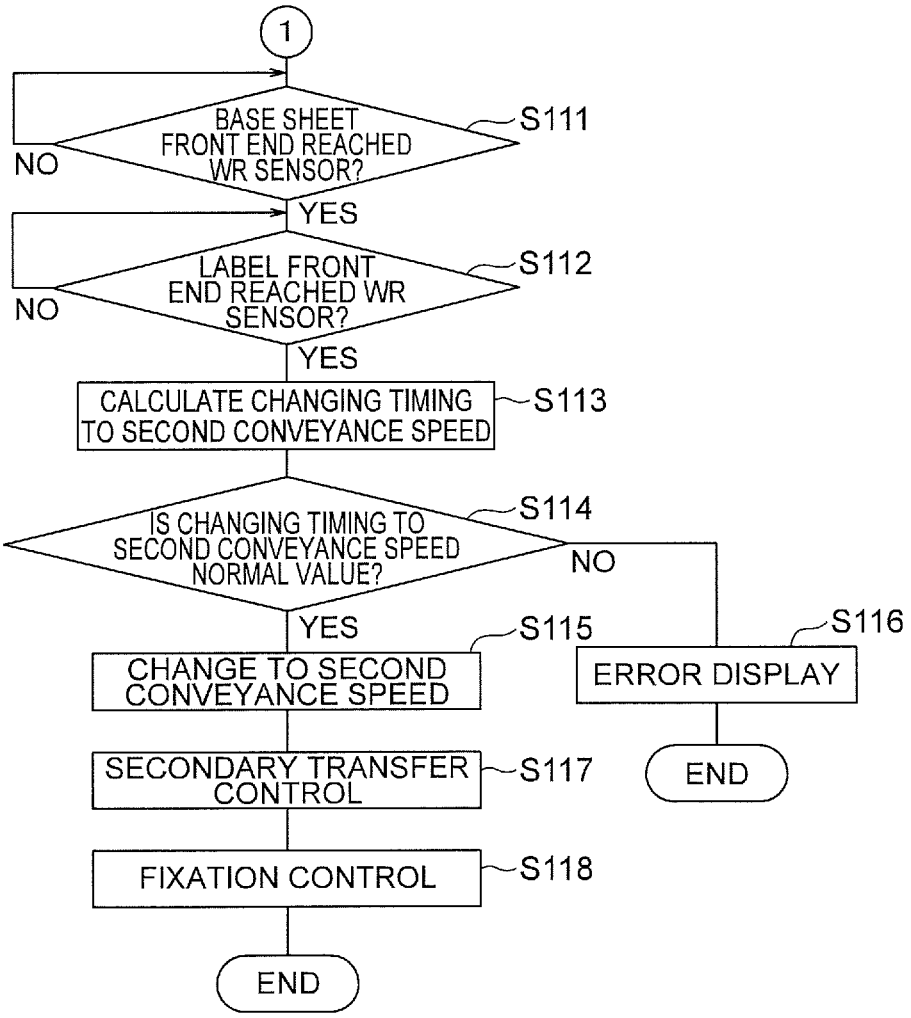
FIG. 6 is a flowchart showing the operation of the image forming apparatus in the first embodiment.
Figure 7A:
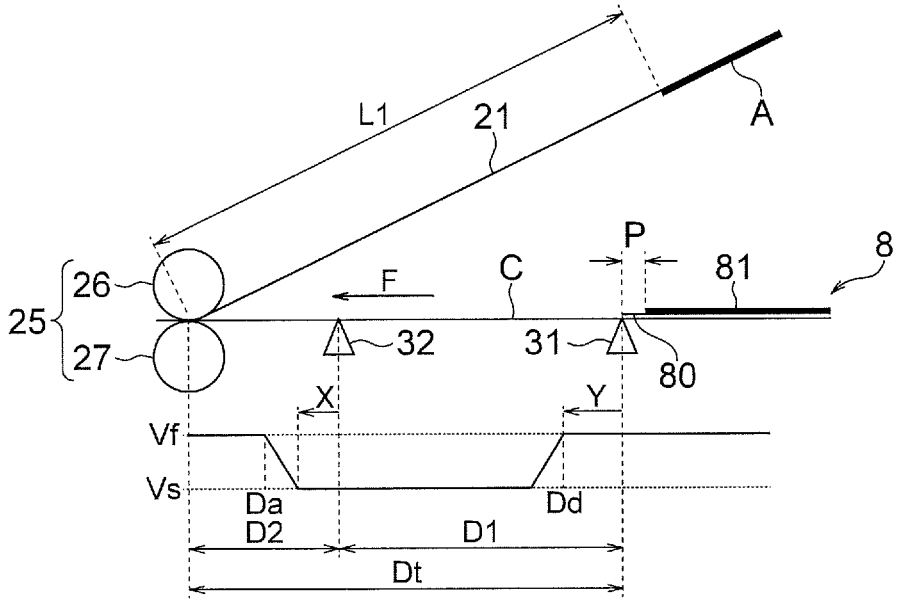
FIGS. 7A and 7B are schematic diagrams for explaining medium conveyance control in the first embodiment.
Figure 7B:
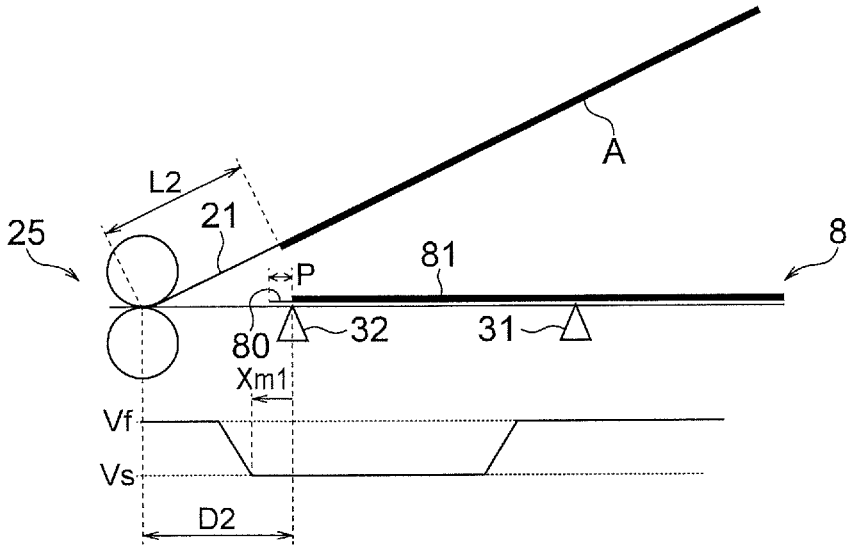

Next, the operation of the image forming apparatus 1 in the first embodiment will be described below. FIGS. 5 and 6 are flowcharts showing the operation of the image forming apparatus 1. These flowcharts are executed by the main control section 100 of the image forming apparatus 1. FIGS. 7A and 7B are schematic diagrams showing the conveyance path of the medium 8 and the intermediate transfer belt 21 in the vicinity of the secondary transfer section 25 and the change in the conveyance speed of the medium 8, wherein the conveyance rollers 30 are not shown.

In the following description, the front end of the medium 8 (base sheet 80 or label 81) means the front end of the medium 8 in the conveyance direction, and the front end of the toner image on the intermediate transfer belt 21 means the front end of the toner image in the traveling direction of the intermediate transfer belt 21. Further, the distance from a certain position to the secondary transfer section 25 means the distance from the position to a nip part formed by the secondary transfer backup roller 26 and the secondary transfer roller 27.

Upon receiving the print command and the print data from the host device (step S101 in FIG. 5), the main control section 100 of the image forming apparatus 1 analyzes the received print command and print data and thereby acquires a medium conveyance speed, a cut length of the medium 8, the length (base sheet front end length) P from the front end of the medium 8 to the front end of the label 81 (step S102). The main control section 100 stores these acquired pieces of information in the storage section 105.

Further, the main control section 100 generates image data, as bitmap data of each color, from the print data and stores the image data in the storage section 105. Furthermore, the main control section 100 stores information on the cut length of the medium 8 acquired from the print command or the like to the feeder control section 150.

Subsequently, the main control section 100 transmits a conveyance start command to the feeder control section 150 via the interface section 102 (step S103). Accordingly, the conveyance rollers 51, 52 and 53 (FIG. 1) in the feeder section 5 start rotating, extract the medium 8 held by the medium holder 50, and convey the medium 8 in the direction indicated by the arrow F, that is, towards the print section 3.

The conveyance speed of the medium 8 by the conveyance rollers 51, 52 and 53 is equal to the traveling speed Vb of the intermediate transfer belt 21 in the print section 3 (i.e., the second conveyance speed Vf of the medium 8 by the conveyance rollers 30).

Subsequently, the main control section 100 judges whether or not the base sheet front end length P acquired in the step S102 is less than a prescribed value (step S104). The prescribed value is a distance D2 from the WR sensor 32 to the secondary transfer section 25.

If the base sheet front end length P is longer that or equal to the distance D2 (NO in the step S104), the process advances to step S110. In the step S110, the main control section 100 makes an error display on a display section of the image forming apparatus 1 and ends the operation. Specifically, the main control section 100 transmits a stop signal to the feeder control section 150 via the interface section 102 and thereby stops the conveyance of the medium 8 by the feeder section 5.

The reason why the operation is ended as above when the base sheet front end length P is longer that or equal to the distance D2 is that the control for registering the toner image on the intermediate transfer belt 21 and the label 81 with each other cannot be carried out if the front end of the medium 8 (i.e., the front end of the base sheet 80) reaches the secondary transfer section 25 before the WR sensor 32 detects the front end of the label 81.

In contrast, if the base sheet front end length P is less than the distance D2 in the aforementioned step S104 (YES in the step S104), the process advances to step S105.

In the step S105, the main control section 100 transmits a print start command to the print control section 103 and the fixation control section 104, by which the image formation in the print section 3 is started.

Specifically, in each process unit 10 (FIG. 3), the photosensitive drum 11 rotates and the charging roller 13 rotates following the photosensitive drum 11. Further, the development roller 14 and the supply roller 15 are rotated by transmission of rotation from the photosensitive drum 11 via gears or the like. Furthermore, the drive roller 23 rotates and thereby causes the intermediate transfer belt 21 to travel.

In each process unit 10, the charging roller 13 is supplied with the charging voltage and uniformly charges the surface of the photosensitive drum 11. The LED head 12 exposes the surface of the photosensitive drum 11 according to the image data of each color and thereby forms an electrostatic latent image.

Meanwhile, the supply roller 15 is supplied with the supply voltage and supplies the toner to the development roller 14. The development blade 16 shapes the toner held on the surface of the development roller 14 into a thin layer. The development roller 14 is supplied with the development voltage, develops the electrostatic latent image on the photosensitive drum 11 with the toner, and thereby forms a toner image (developing agent image).

When the toner image formed on the photosensitive drum 11 reaches the vicinity of the primary transfer roller 22, the primary transfer voltage is applied to the primary transfer roller 22. Due to the primary transfer voltage, the toner image is primarily transferred from the photosensitive drum 11 of each process unit 10Y, 10M, 10C, 10K onto the intermediate transfer belt 21. The toner image on the intermediate transfer belt 21 moves towards the secondary transfer section 25 due to the traveling of the intermediate transfer belt 21.

Meanwhile, the conveyance rollers 51, 52 and 53 of the feeder section 5, which have started the conveyance of the medium 8 in the aforementioned step S103, convey the medium 8 to the print section 3. Incidentally, the feeder control section 150 has grasped the position of each label 81 of the medium 8 by using the second medium sensor 62 (transmissive sensor) and makes the cutter section 55 cut a part of the medium 8 between labels 81 (intermediate position between adjacent labels 81) according to the cut length specified by the print command.

The conveyance control section 110 starts the rotation of the conveyance rollers 30 and thereby conveys the medium, conveyed from the feeder section 5, towards the secondary transfer section 25. At this time point, the conveyance speed of the medium 8 by the conveyance rollers 30 is the second conveyance speed Vf equal to the traveling speed Vb of the intermediate transfer belt 21.

Then, in response to a control signal from the main control section 100, the conveyance control section 110 performs the following control for the registration of the toner image on the intermediate transfer belt 21 and the medium 8:

Specifically, the conveyance control section 110 judges whether or not the front end of the medium 8 supplied to the print section 3 (i.e., the front end of the base sheet 80) has reached the IN sensor 31 based on the output of the IN sensor control section 121 (step S106).

When the IN sensor 31 detects the front end of the base sheet 80 (YES in the step S106), the conveyance control section 110 makes the first conveyance speed timing control section 113 calculate the changing timing to the first conveyance speed Vs (step S107).

The changing timing to the first conveyance speed Vs is calculated based on a distance L1 from the toner image on the intermediate transfer belt 21 to the secondary transfer section 25 (at the time point when the IN sensor 31 detects the front end of the base sheet 80). Therefore, the conveyance control section 110 requests the print control section 103 to supply the information on the distance L1 from the toner image on the intermediate transfer belt 21 to the secondary transfer section 25.

Since the print control section 103 controls the rotation of the photosensitive drums 11, the light emission of the LED heads 12 and the rotation of the drive roller 23 (i.e., the traveling of the intermediate transfer belt 21), the print control section 103 constantly grasps the position of the toner image on the intermediate transfer belt 21. Thus, the print control section 103 outputs the information on the distance L1 from the toner image on the intermediate transfer belt 21 to the secondary transfer section 25 to the conveyance control section 110 in response to the request from the conveyance control section 110.

As shown in FIG. 7A, in this example, the conveyance speed is changed (decelerated) from the second conveyance speed Vf to the first conveyance speed Vs when the medium 8 has advanced for a distance Y since the detection of the front end of the medium 8 (i.e., the front end of the base sheet 80) by the IN sensor 31.

The distance Y is determined based on the distance L1 from the toner image (indicated by the reference character A in FIG. 7) on the intermediate transfer belt 21 to the secondary transfer section 25, the traveling speed Vb of the intermediate transfer belt 21, the first conveyance speed Vs, the second conveyance speed Vf, a distance D1 from the IN sensor 31 to the WR sensor 32, the distance D2 from the WR sensor 32 to the secondary transfer section 25, a distance X from the detection of the front end of the medium 8 by the WR sensor 32 to the changing (acceleration) of the conveyance speed to the second conveyance speed Vf, a distance Dd and a time Td necessary for the deceleration to the first conveyance speed Vs, and a distance Da and a time Ta necessary for the acceleration to the second conveyance speed Vf.

Incidentally, the speeds Vb, Vf and Vs, the distances D1, D2, Dd and Da and the times Td and Ta have previously been set, and stored in the storage section 105, for example. The distance X is provided in order to allow for the base sheet front end length P from the front end of the medium 8 to the label 81. The distance X has previously been set as an estimate value of a distance Xm1 obtained by using an expression (2) described later, and stored in the storage section 105, for example. The second conveyance speed Vf is equal to the traveling speed Vb of the intermediate transfer belt 21 (i.e., Vf=Vb).

Based on the above data, the distance Y, for which the medium 8 advances till the start of the change to the first conveyance speed Vs since the detection of the front end of the base sheet 80 by the IN sensor 31, is represented by the following expression (1):

$$Y = C2 - C1 \cdot L1 \tag{1}$$

$$\text{where } C1 = \frac{Vf \cdot Vs}{Vb(Vf - Vs)} \text{ and}$$

$$C2 = \frac{Vf \cdot Vs(Ta + Td) + Vf(D1 + X - Dd) + Vs(D2 + X - Da)}{Vf - Vs}$$

This expression (1) is an equation derived under a condition that the front end of the medium 8 (the front end of the base sheet 80) and the toner image on the intermediate transfer belt 21 reach the secondary transfer section 25 at the same time in a case where the conveyance speed of the medium 8 is decelerated to the first conveyance speed Vs at the time point when the front end of the base sheet 80 reaches a position at the distance Y from the IN sensor 31, the first conveyance speed Vs is maintained until the front end of the base sheet 80 reaches a position at the distance X from the WR sensor 32, and thereafter the conveyance speed is accelerated to the second conveyance speed Vf. The traveling speed Vb of the intermediate transfer belt 21 (=Vf) is constant.

A value (Y/Vf) obtained by dividing the distance Y calculated as above by the conveyance speed of the medium 8 at this point (i.e., the second conveyance speed Vf) is determined as the changing timing to the first conveyance speed Vs.

Thereafter, the first conveyance speed timing control section 113 judges whether or not the calculation result of the changing timing to the first conveyance speed Vs is a normal value (step S108). Cases where the calculation result of the changing timing to the first conveyance speed Vs is not a normal value include a case where the distance Y represented by the expression (1) takes on a negative value and a case where the distance Y is longer than a distance (Dt−Da−Dd) obtained by subtracting the distances Da and Dd necessary for the acceleration and the deceleration from a distances Dt from the IN sensor 31 to the secondary transfer section 25, for example.

This is because the conveyance control cannot be executed in the case where the distance Y takes on a negative value and the label 81 reaches the secondary transfer section 25 before the completion of the acceleration to the second conveyance speed Vf (after the deceleration to the first conveyance speed Vs) in the case where the distance Y is longer than Dt−Da−Dd.

If the calculation result of the changing timing to the first conveyance speed Vs is not a normal value as above (NO in the step S108), the process advances to the step S110. In the step S110, the main control section 100 makes the error display on the display section of the image forming apparatus 1 and ends the operation. Specifically, the main control section 100 transmits the stop signal to both the print control section 103 and the feeder control section 150 and thereby stops the image formation by the print section 3 and the conveyance of the medium 8 by the feeder section 5.

In contrast, if the calculation result of the changing timing to the first conveyance speed Vs is a normal value in the step S108 (YES in the step S108), the first conveyance speed change control section 111 measures the time by timer count or the like. When the changing timing to the first conveyance speed Vs comes, the conveyance speed is changed to the first conveyance speed Vs (step S109). Incidentally, the starting point of the timer count is the time point when the IN sensor 31 detects the front end of the base sheet 80. Accordingly, the conveyance rollers 30 decelerate to the first conveyance speed Vs and convey the medium 8 at the first conveyance speed Vs.

Subsequently, the main control section 100 judges whether or not the WR sensor 32 has detected the front end of the base sheet 80 of the medium 8 based on the output of the WR sensor control section 122 (step S111 in FIG. 6).

When the WR sensor 32 detects the front end of the base sheet 80 (YES in the step S111), the conveyance control section 110 judges whether or not the WR sensor 32 has detected the front end of the label 81 based on the output of the WR sensor control section 122 (step S112 in FIG. 6).

When the WR sensor 32 detects the front end of the label 81 (YES in the step S112), the conveyance control section 110 makes the second conveyance speed timing control section 114 calculate the changing timing to the second conveyance speed Vf (step S113).

The changing timing to the second conveyance speed Vf is determined based on a distance L2 from the toner image on the intermediate transfer belt 21 to the secondary transfer section 25 (at the time point when the WR sensor 32 detects the front end of the label 81). Therefore, the conveyance control section 110 requests the print control section 103 to supply the information on the distance L2 from the toner image on the intermediate transfer belt 21 to the secondary transfer section 25 and acquires the information.

As shown in FIG. 7B, in this example, the conveyance speed is changed (accelerated) to the second conveyance speed Vf when the medium 8 has advanced for the distance Xm1 since the detection of the front end of the label 81 by the WR sensor 32.

The distance Xm1 is determined based on the aforementioned distance L2 from the toner image to the secondary transfer section 25, the traveling speed Vb of the intermediate transfer belt, the first conveyance speed Vs, the second conveyance speed Vf, the distance D2 from the WR sensor 32 to the secondary transfer section 25, and the distance Da and the time Ta necessary for the acceleration to the second conveyance speed Vf.

As mentioned earlier, the speeds Vb, Vf and Vs, the distances D2 and Da and the time Ta have previously been set, and stored in the storage section 105, for example. The second conveyance speed Vf is equal to the traveling speed Vb of the intermediate transfer belt (Vf=Vb).

Based on the above data, the distance Xm1, for which the medium 8 advances till the start of the change to the second conveyance speed Vf since the detection of the front end of the label 81 by the WR sensor 32, is represented by the following expression (2):

$$Xm1 = C1 \cdot L2 - C3 \quad (2)$$

$$\text{where } C1 = \frac{Vf \cdot Vs}{Vb(Vf - Vs)} \text{ and}$$

$$C3 = \frac{Vs(Vf \cdot Ta + D2 - Da)}{Vf - Vs}$$

This expression (2) is an equation derived under a condition that the front end of the label 81 and the toner image on the intermediate transfer belt 21 reach the secondary transfer section 25 at the same time in a case where the conveyance speed of the medium 8 is accelerated from the first conveyance speed Vs to the second conveyance speed Vf at the time point when the front end of the label 81 reaches a position at the distance Xm1 from the WR sensor 32.

A value (Xm1/Vs) obtained by dividing the distance Xm1 calculated as above by the conveyance speed of the medium 8 at this point (i.e., the first conveyance speed Vs) is determined as the changing timing to the second conveyance speed Vf.

Thereafter, the second conveyance speed timing control section 114 judges whether or not the calculation result of the changing timing to the second conveyance speed Vf is a normal value (step S114). Cases where the calculation result of the changing timing to the second conveyance speed Vf is not a normal value include a case where the distance Xm1 represented by the expression (2) takes on a negative value, for example.

If the calculation result of the changing timing to the second conveyance speed Vf is not a normal value (NO in the step S114), the process advances to step S116. In the step S116, the main control section 100 makes the error display on the display section of the image forming apparatus 1 and ends the operation. Specifically, the main control section 100 transmits the stop signal to both the print control section 103 and the feeder control section 150 and thereby stops the image formation by the print section 3 and the conveyance of the medium 8 by the feeder section 5.

In contrast, if the calculation result of the changing timing to the second conveyance speed Vf is a normal value in the step S114 (YES in the step S114), the second conveyance speed change control section 112 measures the time by timer count or the like. When the changing timing to the second conveyance speed Vf comes, the conveyance speed is changed to the second conveyance speed Vf (step S115). The starting point of the timer count is the time point when the WR sensor 32 detects the front end of the label 81. Accordingly, the conveyance rollers 30 accelerate to the second conveyance speed Vf and convey the medium 8 at the second conveyance speed Vf.

By the above operation, the toner image on the intermediate transfer belt 21 and the label 81 of the medium 8 reach the secondary transfer section 25 at the same time. The print control section 103 applies the secondary transfer voltage to the secondary transfer roller 27 according to a control signal from the main control section 100 in sync with the timing of the arrival of the toner image on the intermediate transfer belt 21 and the label 81 at the secondary transfer section 25. Due to the secondary transfer voltage, the toner image on the intermediate transfer belt 21 is secondarily transferred onto the label 81 of the medium 8 (step S117).

Since the toner image on the intermediate transfer belt 21 and the label 81 of the medium 8 are registered with each other as described above, the toner image can be transferred to a precise position on the label 81.

The medium 8 onto which the toner image has been transferred by the secondary transfer section 25 is conveyed to a nip part formed by the fixation roller 41 and the pressure roller 42 of the fixation device 40. The fixation roller 41 in which the heating was started in the aforementioned step S105 has reached the fixation temperature and is already rotating. The toner image printed on the label 81 of the medium 8 is heated and pressed by the fixation roller 41 and the pressure roller 42 and fused and fixed on the medium 8 (step S118).

The medium 8 on which the toner image has been fixed is ejected by the ejection rollers 45 through the outlet 46, by which the operation of the image forming apparatus 1 is finished.

(Effect of First Embodiment)

As described above, in the first embodiment of the present invention, the conveyance speed of the medium 8 by the conveyance rollers 30 is changed to the first conveyance speed Vs based on the timing of the detection of the medium 8 by the IN sensor 31 (first detection section) and the position of the toner image on the intermediate transfer belt 21 at that time point (i.e., a time point when the medium 8 is detected by the IN sensor 31), and changed to the second conveyance speed Vf based on the timing of the detection of the medium 8 by the WR sensor 32 (second detection section) and the position of the toner image on the intermediate transfer belt 21 at that time point (i.e., a time point when the medium 8 is detected by the WR sensor 32). Accordingly, the toner image on the intermediate transfer belt 21 and the medium 8 can be precisely registered with each other. Therefore, the quality of the image can be improved and the occurrence of the jam with the medium 8 can be inhibited.

Further, since the timing of the change to the first conveyance speed Vs is determined based on the distance L1 from the toner image on the intermediate transfer belt 21 to the secondary transfer section 25 at the time point when the IN sensor 31 detects the medium 8 and the timing of the change to the second conveyance speed Vf is determined based on the distance L2 from the toner image on the intermediate transfer belt 21 to the secondary transfer section 25 at the time point when the WR sensor 32 detects the medium 8, the toner image on the intermediate transfer belt 21 and the medium 8 can be registered with each other more precisely.

Furthermore, since the label 81 of the medium 8 is detected by the WR sensor 32, the position of the label 81 as the image formation position can be grasped precisely and the position of the toner image on the intermediate transfer belt 21 can be registered with the image formation position.

Moreover, when the base sheet front end length P as the length from the front end of the medium 8 (the front end of the base sheet 80) to the label 81 is greater than or equal to the prescribed value (specifically, the distance D2 from the WR sensor 32 to the secondary transfer section 25), the image formation by the print section 3 is not carried out. Therefore, it is possible to carry out the image formation exclusively when the registration of the label 81 and the toner image is possible, by which the image quality can be improved.

Second Embodiment (Configuration of Image Forming Apparatus)

Figure 8:
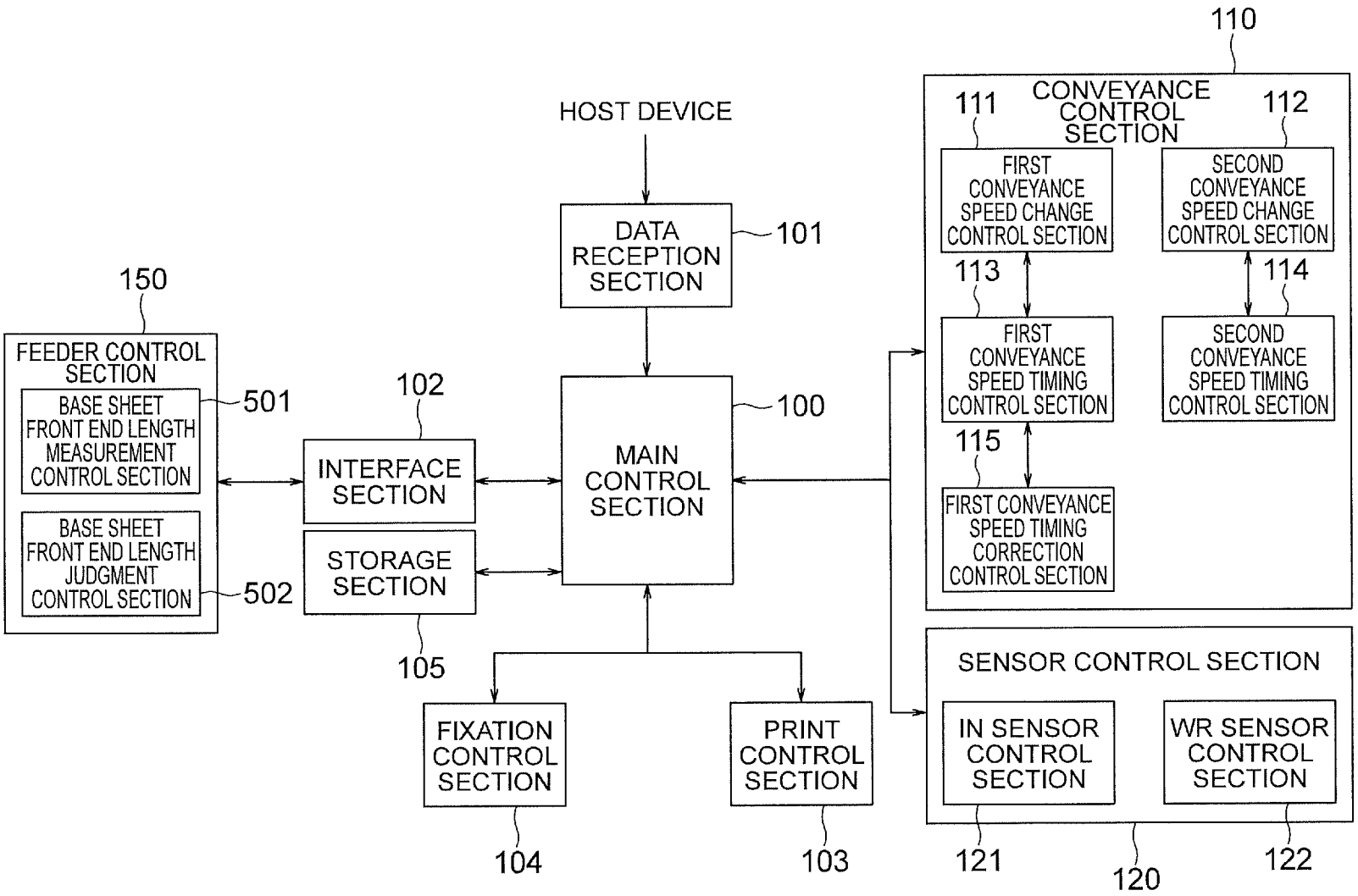
FIG. 8 is a block diagram showing a control system of an image forming apparatus in a second embodiment.

Next, a second embodiment of the present invention will be described below. FIG. 8 is a block diagram showing a control system of an image forming apparatus in the second embodiment. The control system of the image forming apparatus in the second embodiment is essentially equivalent to the control system (FIG. 4) of the image forming apparatus in the first embodiment except that the feeder control section 150 includes a base sheet front end length measurement control section 501 and a base sheet front end length judgment control section 502 and the conveyance control section 110 includes a first conveyance speed timing correction control section 115. The configurations of the print section 3 and the feeder section 5 are equivalent to those of the print section 3 and the feeder section 5 in the first embodiment (FIG. 1).

The base sheet front end length measurement control section 501 (medium front end length measurement section) of the feeder control section 150 detects the front end of the base sheet 80 of the medium 8 and the front end of the label 81 by use of the second medium sensor 62 as the transmissive sensor in the feeder section 5 and measures the base sheet front end length P (i.e., the distance from the front end of the base sheet 80 to the front end of the label 81) based on the result of the detection.

The base sheet front end length measurement control section 501 transmits the measured base sheet front end length P to the main control section 100 via the interface section 102. The main control section 100 outputs the received base sheet front end length P to the conveyance control section 110.

The base sheet front end length judgment control section 502 (medium front end length judgment section) of the feeder control section 150 judges whether or not the base sheet front end length P measured by the base sheet front end length measurement control section 501 is less than a prescribed value. The prescribed value will be explained later.

The first conveyance speed timing correction control section 115 (timing correction section) of the conveyance control section 110 corrects the changing timing to the first conveyance speed Vs (calculated by the first conveyance speed timing control section 113) by using the base sheet front end length P acquired from the base sheet front end length measurement control section 501.

(Operation of Image Forming Apparatus)

Figure 9:
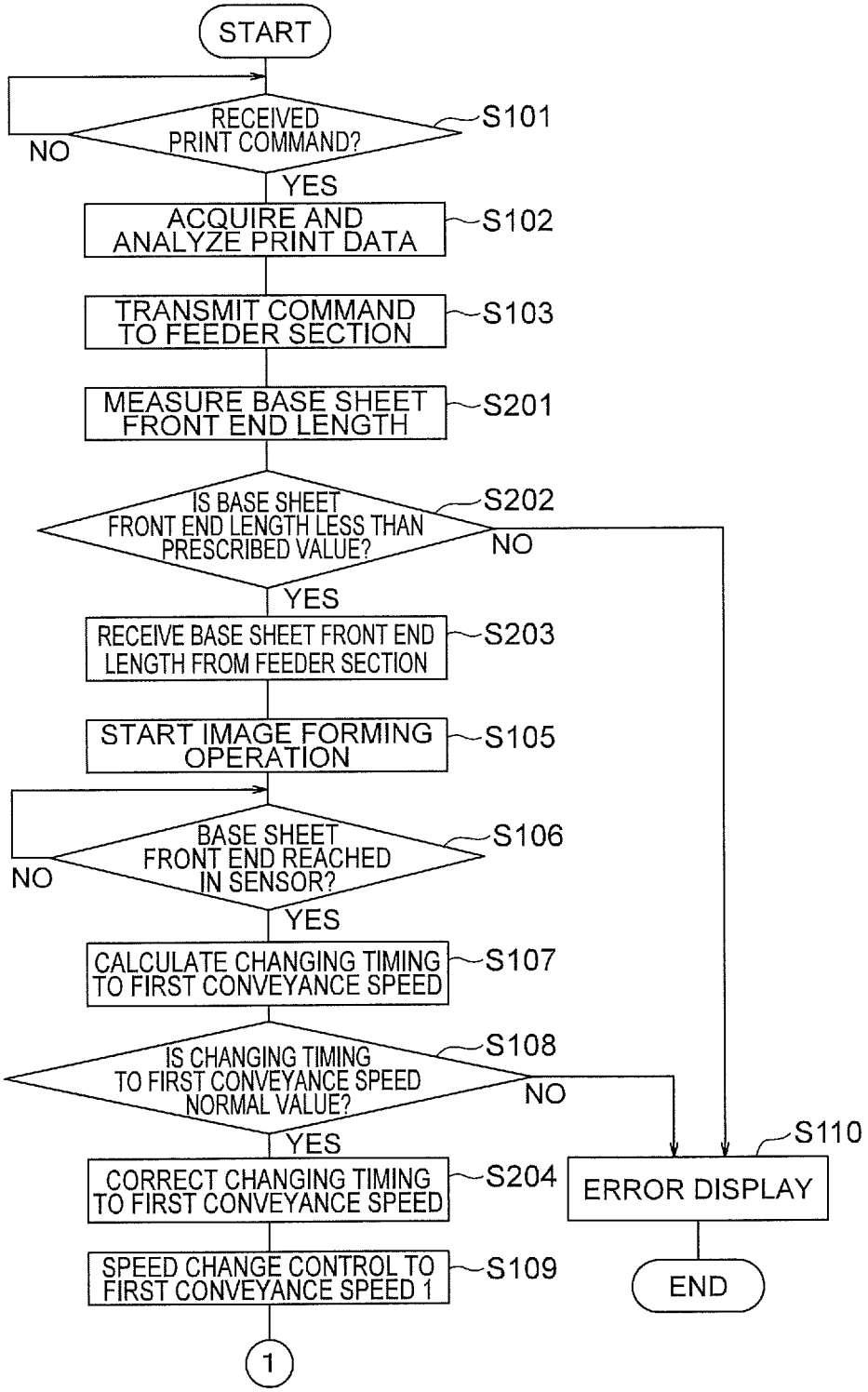
FIG. 9 is a flowchart showing the operation of the image forming apparatus in the second embodiment.

Next, the operation of the image forming apparatus in the second embodiment will be described below. FIG. 9 is a flowchart showing the operation of the image forming apparatus. FIGS. 10A to 10D are schematic diagrams showing the conveyance path in the print section 3 to the secondary transfer section 25 and the change in the conveyance speed, wherein the conveyance rollers 30 are not shown.

The processing in the steps S101 to S103 in FIG. 9 is equivalent to that in the first embodiment. Specifically, upon receiving the print command and the print data (step S101), the main control section 100 acquires necessary data by analyzing the received print command and print data (step S102) and transmits the conveyance start command to the feeder control section 150 (step S103). In the feeder section 5, the conveyance of the medium 8 by the conveyance rollers 51, 52 and 53 is started.

Subsequently, the base sheet front end length measurement control section 501 of the feeder control section 150 measures the base sheet front end length P of the medium 8 in response to a control signal from the main control section 100 (step S201). The base sheet front end length measurement control section 501 determines the base sheet front end length P from the timing of the detection of the front end of the base sheet 80 and the timing of the detection of the front end of the label 81 by the second medium sensor 62 of the feeder section 5.

Subsequently, the base sheet front end length judgment control section 502 judges whether or not the base sheet front end length P measured by the base sheet front end length measurement control section 501 is less than the prescribed value (step S202). The prescribed value is set as described below.

Figure 10A:
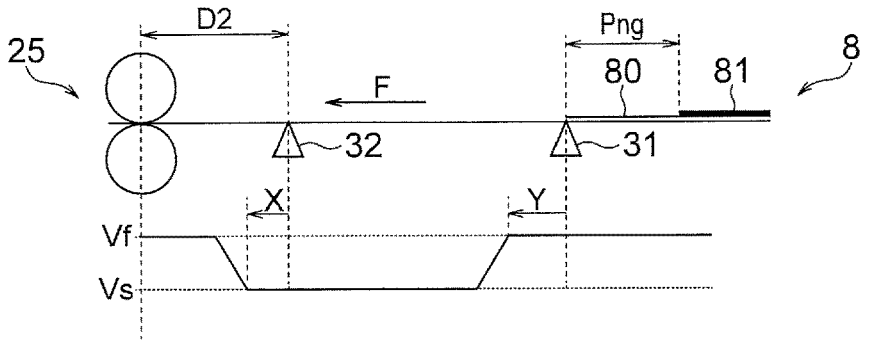
FIGS. 10A to 10D are schematic diagrams for explaining the medium conveyance control in the second embodiment.

In the example shown in FIG. 10A, the base sheet front end length Png of the medium 8 is shorter than the distance D2 from the WR sensor 32 to the secondary transfer section 25 but is longer than or equal to a distance D2−Da obtained by subtracting the distance Da necessary for the acceleration from the distance D2 (i.e., D2>Png≥D2−Da).

Figure 10B:
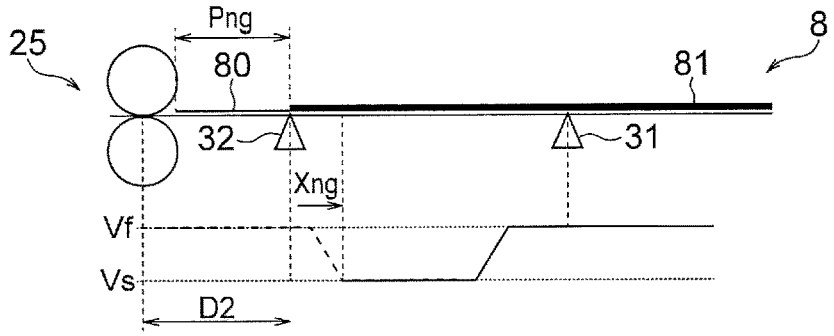

In this case, as shown in FIG. 10B, at the time point when the WR sensor 32 detects the front end of the label 81, the distance (D2−Png) from the front end of the base sheet 80 to the secondary transfer section 25 is less than or equal to the distance Da necessary for the acceleration. Accordingly, as indicated by the reference character Xng in FIG. 10B, it becomes necessary to start the acceleration to the second conveyance speed Vf before the time point when the WR sensor 32 detects the front end of the label 81.

Therefore, in this second embodiment, the image formation is not carried out in cases where the acceleration to the second conveyance speed Vf has to be started before the WR sensor 32 detects the front end of the label 81 (in other words, in cases where the base sheet front end length P is longer than or equal to the distance D2−Da).

Namely, when the base sheet front end length judgment control section 502 judges that the base sheet front end length P is longer than or equal to the distance D2−Da (prescribed value) (NO in the step S202), the process advances to the step S110, the error display is made on the display section of the image forming apparatus 1, and the operation is ended.

In contrast, if the base sheet front end length P is shorter than the distance D2−Da (YES in the step S202), the process advances to step S203. In the step S203, the main control section 100 receives the base sheet front end length P from the base sheet front end length measurement control section 501.

Subsequently, the main control section 100 transmits the start command to the print control section 103 and the fixation control section 104 (step S105). Accordingly, the image formation in the print section 3 is started. Specifically, as explained in the first embodiment, a toner image is formed in each process unit 10, primarily transferred onto the intermediate transfer belt 21, and heads towards the secondary transfer section 25 due to the traveling of the intermediate transfer belt 21.

The subsequent steps S106 to S108 are equivalent to the steps S106 to S108 in the first embodiment. Specifically, when the IN sensor 31 detects the front end of the base sheet 80 (step S106), the first conveyance speed timing control section 113 calculates the changing timing to the first conveyance speed Vs in response to a control signal from the main control section 100 (step S107). Namely, the distance Y is calculated from the expression (1) described in the first embodiment and the timing corresponding to the distance Y is determined.

Further, the first conveyance speed timing control section 113 judges whether or not the changing timing calculated in the step S107 is a normal value (step S108). The criterion of the judgment on whether the calculated changing timing is a normal value or not is as explained in the first embodiment.

If the changing timing to the first conveyance speed Vs is not a normal value in the step S108 (NO in the step S108), the process advances to the step S110. In the step S110, the main control section 100 makes the error display on the display section of the image forming apparatus 1 and ends the operation.

In contrast, if the changing timing to the first conveyance speed Vs is a normal value in the step S108 (YES in the step S108), the conveyance control section 110 makes the first conveyance speed timing correction control section 115 correct the changing timing to the first conveyance speed Vs calculated in the step S107 (step S204).

Figure 10C:
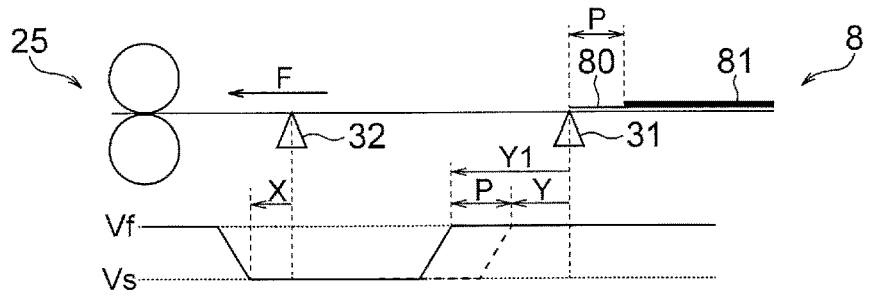
Figure 10D:
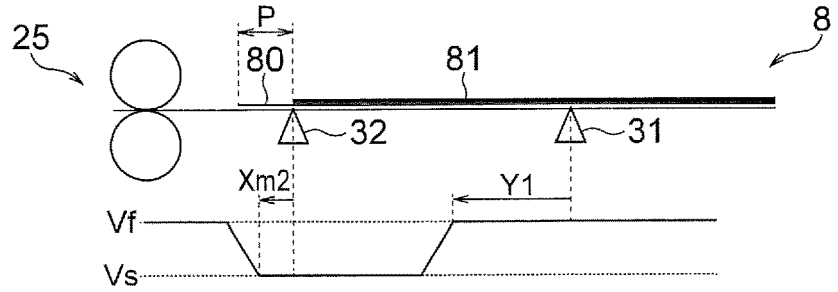

As shown in FIG. 10C, in this second embodiment, the changing (decelerating) timing to the first conveyance speed Vs is set to the time point when the medium 8 has advanced for a distance Y1 (=Y+P) since the detection of the front end of the base sheet 80 by the IN sensor 31. The distance Y1 is a value obtained by adding the base sheet front end length P measured by the base sheet front end length measurement control section 501 to the distance Y calculated in the step S107.

The distance Xm1 (FIG. 7B) explained in the first embodiment, which is determined from the aforementioned expression (2) based on the distance L2 from the toner image on the intermediate transfer belt 21 to the secondary transfer section 25, can take on an extremely small value, and there is a possibility that it is impossible to secure a sufficient time from the detection of the front end of the label 81 by the WR sensor 32 to the start of the acceleration to the second conveyance speed Vf.

In this second embodiment, the timing of the deceleration to the first conveyance speed Vs is delayed by correcting the distance Y to the distance Y1 (=Y+P) in the step S204, and thus the timing of the acceleration to the second conveyance speed Vf can be delayed accordingly. Therefore, as indicated by the reference character Xm2 in FIG. 10D, a sufficient time from the detection of the front end of the label 81 by the WR sensor 32 to the start of the acceleration to the second conveyance speed Vf can be secured.

Incidentally, depending on the base sheet front end length P, there is a possibility that delaying the timing of the acceleration to the second conveyance speed Vf causes the front end of the base sheet 80 to reach the secondary transfer section 25 before the completion of the acceleration. This point will be described later in a third embodiment.

After the correction of the changing timing to the first conveyance speed Vs in the step S204, the first conveyance speed change control section 111 measures the time by timer count or the like, and changes the conveyance speed to the first conveyance speed Vs when the timing of the deceleration to the first conveyance speed Vs comes (step S109). Steps after the step S109 are as described in the first embodiment (FIGS. 5 and 6).

(Effect of Second Embodiment)

As described above, in the second embodiment of the present invention, the base sheet front end length P as the distance from the front end of the medium 8 (the front end of the base sheet 80) to the label 81 (image formation position) is measured (step S201), by which the base sheet front end length P can be grasped more precisely. Further, since the image formation by the print section 3 is not carried out when the base sheet front end length P is greater than or equal to the prescribed value, the quality of the image can be improved and the jam with the medium 8 can be inhibited.

Furthermore, the image formation by the print section 3 is not carried out when the base sheet front end length P is greater than the value D2−Da obtained by subtracting the distance Da necessary for the acceleration from the distance D2 from the WR sensor 32 to the secondary transfer section 25. Therefore, it is possible to carry out the image formation exclusively when the registration of the label 81 and the toner image is possible, by which the image quality can be improved.

Moreover, since the changing timing to the first conveyance speed Vs is determined based on the distance L1 from the toner image on the intermediate transfer belt 21 to the secondary transfer section 25 and the base sheet front end length P (step S204), a sufficient time from the detection of the front end of the label 81 by the WR sensor 32 to the start of the acceleration to the second conveyance speed Vf can be secured.

Incidentally, while the base sheet front end length P is measured in this example by using the base sheet front end length measurement control section 501 and the second medium sensor 62, it is also possible to acquire the base sheet front end length P from the print command as in the first embodiment and make the judgment on whether or not the base sheet front end length P is within a prescribed range (step S202).

Third Embodiment (Configuration of Image Forming Apparatus)

Figure 11:
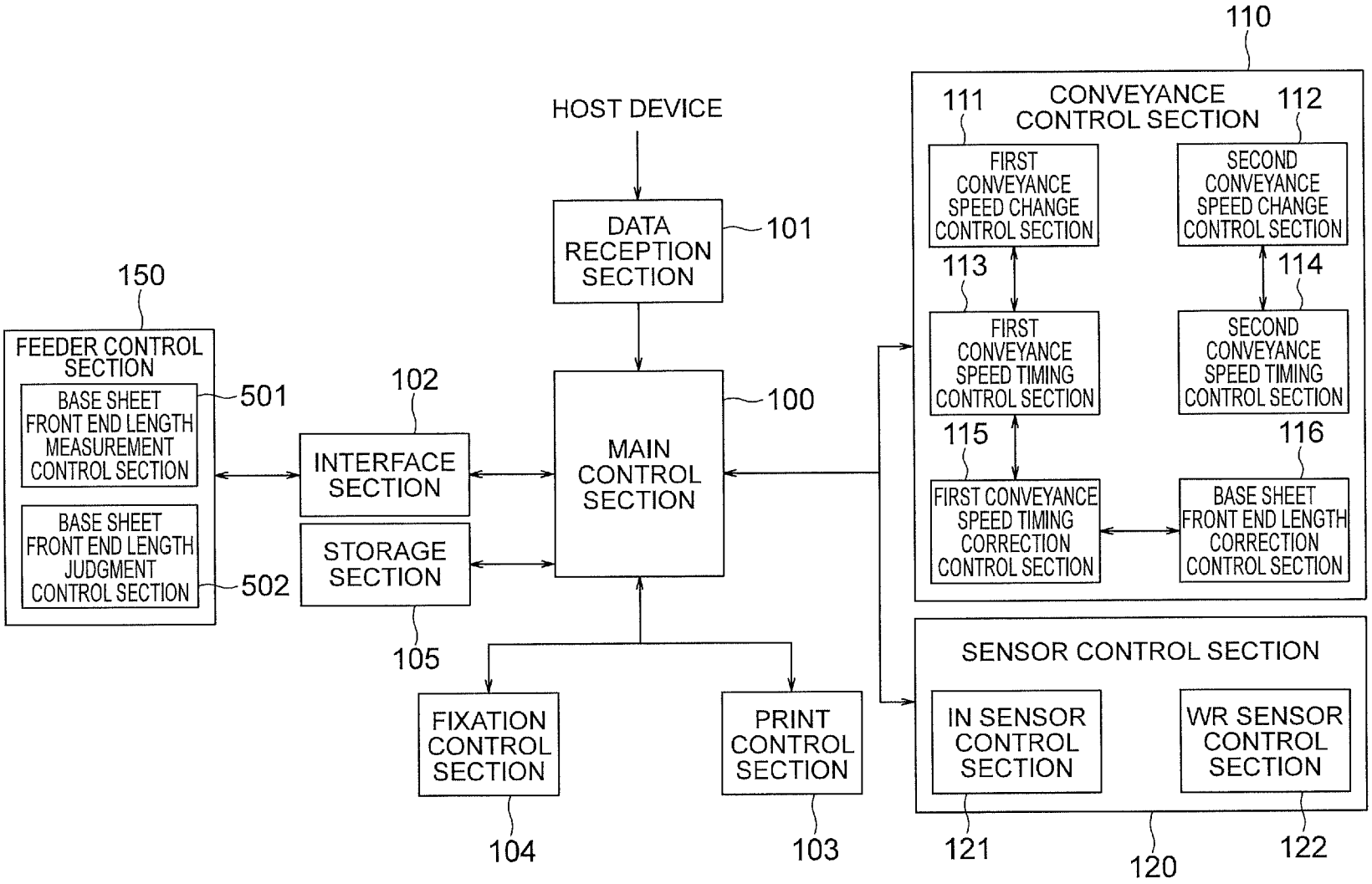
FIG. 11 is a block diagram showing a control system of an image forming apparatus in a third embodiment.

Next, a third embodiment of the present invention will be described below. FIG. 11 is a block diagram showing a control system of an image forming apparatus in the third embodiment. The control system of the image forming apparatus in the third embodiment is essentially equivalent to the control system (FIG. 8) of the image forming apparatus in the second embodiment except that the conveyance control section 110 includes a base sheet front end length correction control section 116. The configurations of the print section 3 and the feeder section 5 are equivalent to those of the print section 3 and the feeder section 5 in the first embodiment (FIG. 1).

The base sheet front end length correction control section 116 (medium front end length correction section) of the conveyance control section 110 corrects the base sheet front end length P acquired by the first conveyance speed timing correction control section 115 explained in the second embodiment as needed.

(Operation of Image Forming Apparatus)

Figure 12:
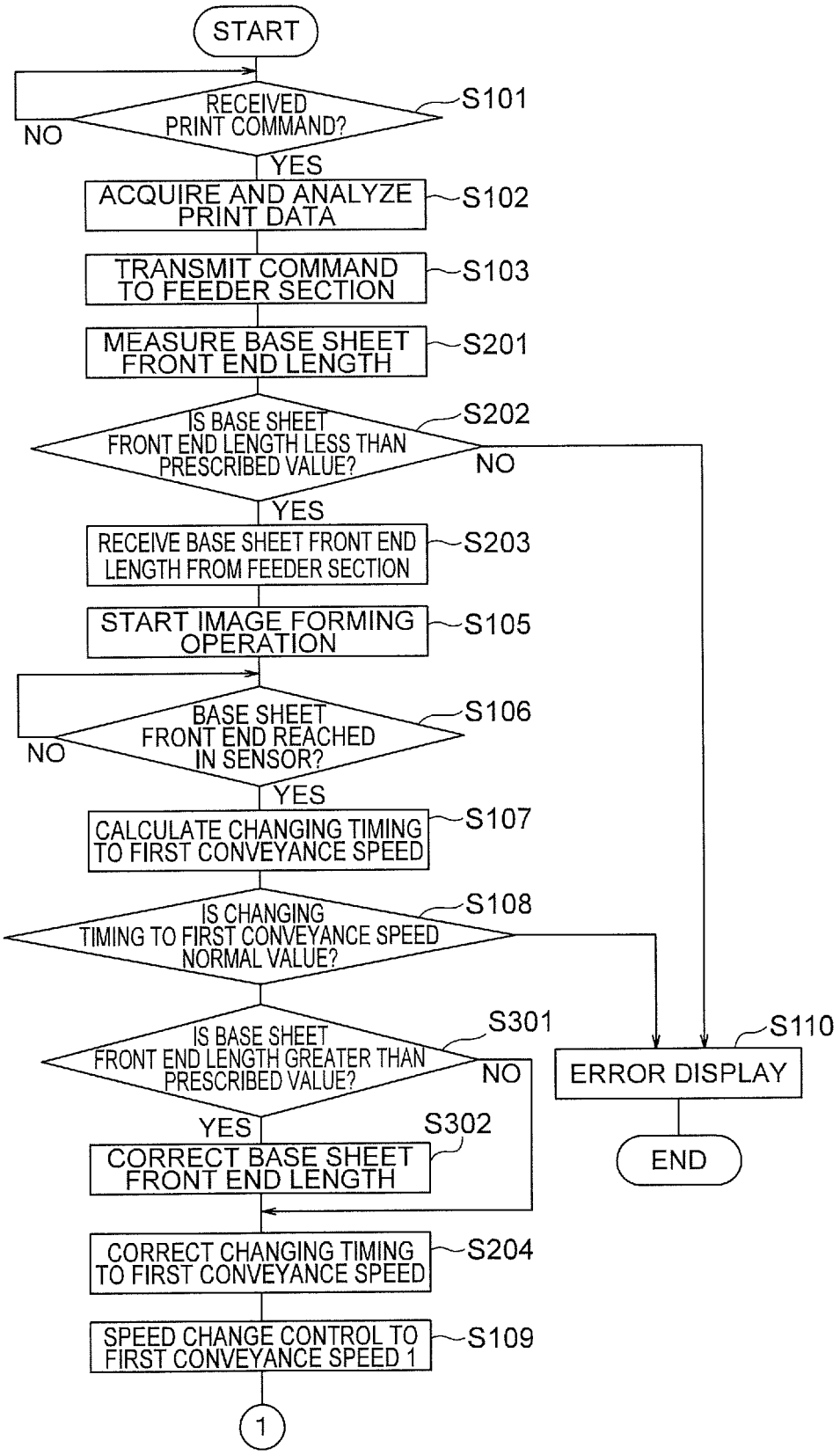
FIG. 12 is a flowchart showing the operation of the image forming apparatus in the third embodiment.

Next, the operation of the image forming apparatus in the third embodiment will be described below. FIG. 12 is a flowchart showing the operation of the image forming apparatus. FIGS. 13A to 13D are schematic diagrams showing the conveyance path in the print section 3 to the secondary transfer section 25 and the change in the conveyance speed, wherein the conveyance rollers 30 are not shown.

The processing in the steps S101 to S108 (including the steps S201 to S203) in FIG. 12 is equivalent to that in the second embodiment. Specifically, upon receiving the print command and the print data (step S101), the main control section 100 acquires necessary data by analyzing the received print command and print data (step S102) and transmits the conveyance start command to the feeder control section 150 (step S103). In the feeder section 5, the conveyance of the medium 8 by the conveyance rollers 51, 52 and 53 is started.

Further, in the feeder section 5, the base sheet front end length measurement control section 501 measures the base sheet front end length P of the medium 8 by using the second medium sensor 62 (step S201) and the base sheet front end length judgment control section 502 judges whether or not the base sheet front end length P is less than the prescribed value (D2−Da) (step S202). If the base sheet front end length P is less than the prescribed value, the print section 3 starts the image formation (step S105) and the toner image is formed in each process unit 10 and primarily transferred onto the intermediate transfer belt 21.

When the IN sensor 31 detects the front end of the base sheet 80 (step S106), the first conveyance speed timing control section 113 calculates the changing timing to the first conveyance speed Vs (step S107) and judges whether or not the calculated changing timing is a normal value (step S108). The criterion of the judgment on whether the changing timing is a normal value or not is as explained in the first embodiment.

If the changing timing to the first conveyance speed Vs is not a normal value in the step S108 (NO in the step S108), the main control section 100 advances to the step S110, makes the error display on the display section of the image forming apparatus 1, and ends the operation.

In contrast, if the changing timing to the first conveyance speed Vs is a normal value in the step S108 (YES in the step S108), the main control section 100 advances to step S301 and judges whether or not the base sheet front end length P is greater than a prescribed value (D2−Da−X). This point will be described below.

Figure 13A:
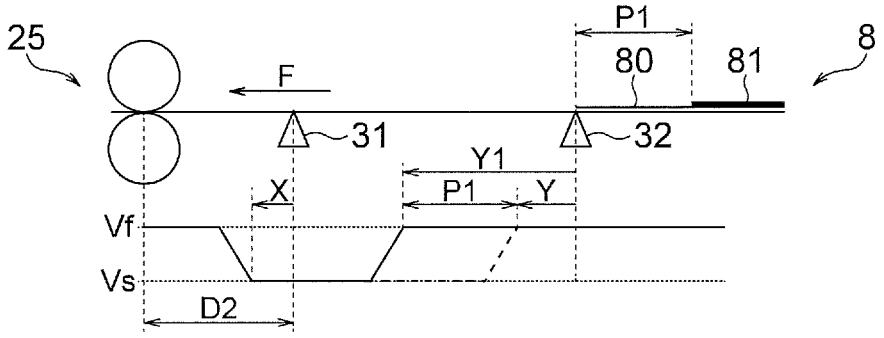
FIGS. 13A to 13D are schematic diagrams for explaining the medium conveyance control in the third embodiment.

In the example shown in FIG. 13A, the base sheet front end length P1 of the medium 8 is shorter than the distance D2−Da explained in the second embodiment but is assumed to be longer than the distance D2−Da−X obtained by subtracting the distance X from the distance D2−Da (i.e., P1>D2−Da−X). As mentioned earlier, the distance X corresponds to the time (estimated time) from the detection of the front end of the label 81 by the WR sensor 32 to the acceleration to the second conveyance speed Vf.

In this case, if the timing of decelerating the conveyance speed of the medium 8 to the first conveyance speed Vs is corrected as described in the second embodiment to the time point when the medium 8 has advanced for the distance Y1 (=Y+P) since the detection of the front end of the base sheet 80 by the IN sensor 31 (step S204 in FIG. 9), only a distance shorter than Da+X remains between the front end of the label 81 and the secondary transfer section 25 at the time point when the WR sensor 32 detects the front end of the label 81. In other words, there is no margin to convey the medium 8 further for the distance X and accelerate the conveyance speed to the second conveyance speed Vf (i.e., convey the medium 8 for the distance Da).

Figure 13B:
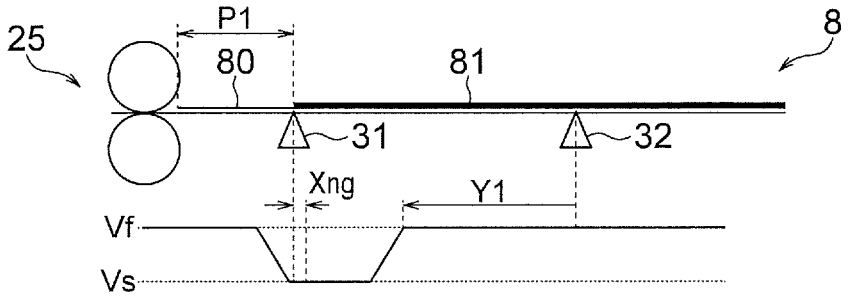
Figure 13C:
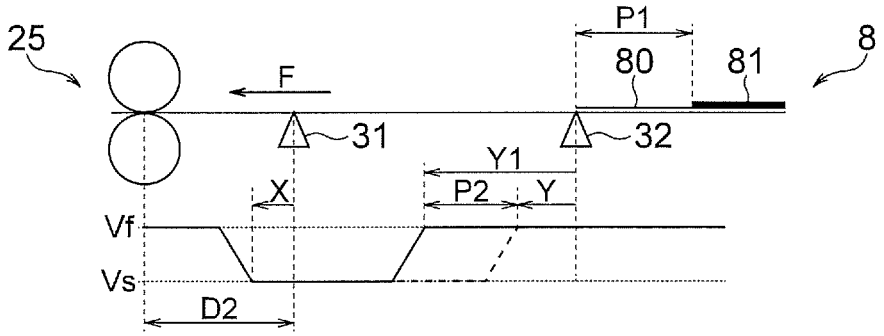
Figure 13D:
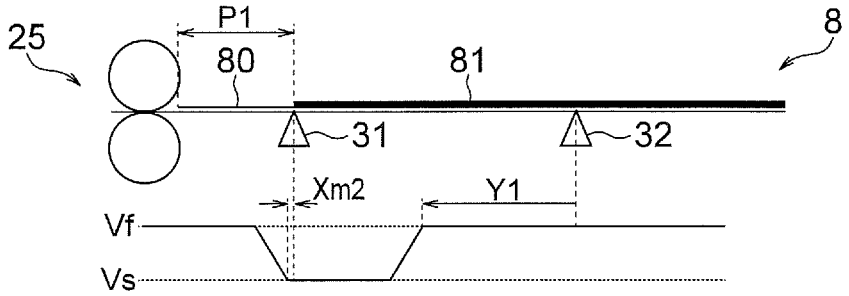

Thus, it becomes necessary to start the acceleration to the second conveyance speed Vf before the time point when the WR sensor 32 detects the front end of the label 81 as indicated by the reference character Xng in FIG. 13B.

Therefore, when the base sheet front end length P1 is longer than the distance D2−Da−X (YES in the step S301), the base sheet front end length correction control section 116 of the conveyance control section 110 corrects the base sheet front end length P1 to the distance D2−Da−X (step S302). This distance D2−Da−X will be referred to as a base sheet front end length P2 (prescribed length).

In the subsequent step S204, the changing timing to the first conveyance speed Vs is corrected as described in the second embodiment. However, since the base sheet front end length P1 has been corrected to P2, the distance from the detection of the front end of the base sheet 80 by the IN sensor 31 to the acceleration to the first conveyance speed Vs changes to a distance Y2 (=Y+P2) obtained by adding the base sheet front end length P2 (=D2−Da−X) to the distance Y1 calculated in the step S107.

Therefore, even in the case where the base sheet front end length P1 of the medium 8 is longer than the distance D2−Da−X (=P2), the distance Da+X remains between the front end of the label 81 and the secondary transfer section 25 at the time point when the WR sensor 32 detects the front end of the label 81. Accordingly, the timing for the acceleration to the second conveyance speed Vf can be secured. In other words, the toner image on the intermediate transfer belt 21 and the label 81 can be registered with each other even in cases where the base sheet front end length P1 is long.

After the correction of the timing of the change (deceleration) to the first conveyance speed Vs in the step S204, the first conveyance speed change control section 111 measures the time by timer count or the like, and changes the conveyance speed to the first conveyance speed Vs when the timing of the deceleration to the first conveyance speed Vs comes (step S109).

Incidentally, although the timing when the label 81 reaches the WR sensor 32 is delayed by a time corresponding to the difference Diff (=P1−P2) between the base sheet front end lengths P1 and P2, the first conveyance speed change control section 111 judges that the timing when the label 81 reaches the WR sensor 32 is delayed by Diff and starts the acceleration to the second conveyance speed Vf earlier correspondingly (with timing corresponding to the distance Xm2 shown in FIG. 13D), which enables the label 81 and the toner image on the intermediate transfer belt 21 to reach the secondary transfer section 25 at the same time.

Steps after the step S109 are as described in the first embodiment (FIGS. 5 and 6).

(Effect of Third Embodiment)

As described above, in the third embodiment of the present invention, when the base sheet front end length P1 as the distance from the front end of the medium 8 (the front end of the base sheet 80) to the label 81 (image formation position) is greater than the prescribed value (P2=D2−Da−X), the base sheet front end length P1 is corrected to the prescribed value P2. Accordingly, even in cases where the base sheet front end length P1 is long, the toner image on the intermediate transfer belt 21 and the label 81 can be registered with each other and the image quality can be improved.

Incidentally, while the base sheet front end length P is measured in this example by using the base sheet front end length measurement control section 501 and the second medium sensor 62, it is also possible to acquire the base sheet front end length P1 from the print command as in the first embodiment and correct the base sheet front end length P1 to the base sheet front end length P2 (step S302) when the base sheet front end length P1 is greater than the prescribed value (P2=D2−Da−X).

While the description of the above embodiments has been given of a medium 8 having a base sheet 80 and labels 81 (e.g., label roll paper), the medium is not limited to this type of medium; any type of medium having a certain image formation position (image formation region) on its surface may be used.

While the first conveyance speed Vs (adjusted speed) is assumed to be lower than the second conveyance speed Vf (regular conveyance speed) in the above embodiments, the first conveyance speed Vs may be higher than the second conveyance speed Vf.

While the description of the above embodiments has been given of a printer as an example of the image forming apparatus, the image forming apparatus is not limited to a printer but may be a copier, a facsimile machine, an MFP (Multifunction Peripheral), or the like. Further, the image forming apparatus is not limited to a device forming color images but may be a device forming unicolor images.

While preferred embodiments of the present invention have been described specifically above, the present invention is not limited to the above-described embodiments and a variety of improvements or modifications are possible within the range not departing from the subject matter of the present invention. For example, part of the control system illustrated in FIG. 4, 8 or 11 may be implemented by a processor that executes a program stored in a memory.

What is claimed is:

1. An image forming apparatus comprising:

an image forming section that forms an image;

an intermediate transfer body traveling at a prescribed speed, the image formed by the image forming section being primarily transferred onto the intermediate transfer body;

a secondary transfer section that secondarily transfers the image on the intermediate transfer body onto a medium;

a conveyance section that conveys the medium to the secondary transfer section;

a first detection section that detects the medium;

a second detection section that is arranged downstream of the first detection section in a conveyance direction of the medium by the conveyance section and detects the medium; and a control section which controls the image forming section to form the image on the intermediate transfer body, thereby grasping a position of the image on the intermediate transfer body, the control section also performing control for changing a conveyance speed of the medium by the conveyance section to a first speed based on timing of detection of the medium by the first detection section and based on the position of the image on the intermediate transfer body at a time point when the medium is detected by the first detection section and changing the conveyance speed of the medium by the conveyance section to a second speed equal to the prescribed speed of the intermediate transfer body based on timing of detection of the medium by the second detection section and based on the position of the image on the intermediate transfer body at a time point when the medium is detected by the second detection section, wherein, in a case where the medium has a base sheet and a label provided on the base sheet, the first detection section detects a front end of the medium, the second detection section detects a front end of the label, and the control section determines timing of a change of the conveyance speed to the first speed based on the detection of the front end of the base sheet by the first detection section and timing of a change of the conveyance speed to the second speed based on the detection of the front end of the label by the second detection section.

2. The image forming apparatus according to claim 1, wherein the control section acquires a distance L1 from the image on the intermediate transfer body to the secondary transfer section at the time point of the detection of the front end of the base sheet by the first detection section and determines the timing of the change to the first speed based on the distance L1.

3. The image forming apparatus according to claim 1, wherein the control section acquires a distance L2 from the image on the intermediate transfer body to the secondary transfer section at the time point of the detection of the front end of the label by the second detection section and determines the timing of the change to the second speed based on the distance L2.

4. An image forming apparatus comprising:

an image forming section that forms an image;

an intermediate transfer body traveling at a prescribed speed, the image formed by the image forming section being primarily transferred onto the intermediate transfer body;

a secondary transfer section that secondarily transfers the image on the intermediate transfer body onto a medium;

a conveyance section that conveys the medium to the secondary transfer section;

a first detection section;

a second detection section that is arranged downstream of the first detection section in a conveyance direction of the medium by the conveyance section and detects the medium; and a control section which controls the image forming section to form the image on the intermediate transfer body, thereby grasping a position of the image on the intermediate transfer body, the control section also performing control for changing a conveyance speed of the medium by the conveyance section to a first speed based on timing of detection of the medium by the first detection section and based on the position of the image on the intermediate transfer body at a time point when the medium is detected by the first detection section and changing the conveyance speed of the medium by the conveyance section to a second speed equal to the prescribed speed of the intermediate transfer body based on timing of detection of the medium by the second detection section and based on the position of the image on the intermediate transfer body at a time point when the medium is detected by the second detection section, wherein the first detection section detects the medium, the second detection section detects an image formation position provided on the medium and the control section acquires a medium front end length as a length from a front end of the medium to the image formation position in the conveyance direction and does not make the image forming section carry out the image formation when the medium front end length is greater than or equal to a prescribed value.

5. The image forming apparatus according to claim 4, wherein the control section acquires the medium front end length from a print command.

6. The image forming apparatus according to claim 4, further comprising a measurement section that measures the medium front end length, wherein the control section acquires the medium front end length from the measurement section.

7. The image forming apparatus according to claim 4, wherein the prescribed value is a distance D2 from the second detection section to the secondary transfer section.

8. The image forming apparatus according to claim 4, wherein the prescribed value is a value obtained by subtracting a distance Da necessary for the change from the first speed to the second speed from a distance D2 from the second detection section to the secondary transfer section.

9. The image forming apparatus according to claim 4, wherein the control section determines timing of the change to the first speed based on a distance L1 from the image on the intermediate transfer body to the secondary transfer section at the time point of the detection of the medium by the first detection section and the medium front end length.

10. The image forming apparatus according to claim 9, wherein when the medium front end length is longer than a prescribed length, the control section corrects the medium front end length to the prescribed length.

11. The image forming apparatus according to claim 10, wherein the prescribed length is a value obtained by subtracting, from a distance D2 from the second detection section to the secondary transfer section, a distance Da necessary for the change from the first speed to the second speed and a distance X, for which the medium advances in a previously set time from the detection of the medium by the second detection section to the change to the second speed.

12. The image forming apparatus according to claim 1, wherein the second speed is lower than the first speed.

* * * * *